US005472522A

United States Patent [19]

Kawaguchi et al.

[11] Patent Number: 5,472,522

[45] Date of Patent: Dec. 5, 1995

[54] MAKING GALVANIZED STEEL WITH EXCELLENT DARKENING RESISTANCE

[75] Inventors: Jun Kawaguchi, Tokyo; Takao Ogino; Kensuke Mizuno, both of Kanagawa, all of Japan

[73] Assignee: Henkel Corporation, Plymouth Meeting, Pa.

[21] Appl. No.: 302,800

[22] PCT Filed: Mar. 15, 1993

[86] PCT No.: PCT/US93/02155

§ 371 Date: Sep. 15, 1994

§ 102(e) Date: Sep. 15, 1994

[87] PCT Pub. No.: WO93/19224

PCT Pub. Date: Sep. 30, 1993

[30] Foreign Application Priority Data

Mar. 17, 1992 [JP] Japan ..... 4-091775

[51] Int. Cl.[6] ..... C23C 22/73; C23C 22/36

[52] U.S. Cl. ..... 148/255; 148/262

[58] Field of Search ..... 148/262, 255

[56] References Cited

U.S. PATENT DOCUMENTS 5,152,849 10/1992 Bittner ..... 148/262

FOREIGN PATENT DOCUMENTS 0244022 11/1987 European Pat. Off. .
0381190 8/1990 European Pat. Off. .
0414296 2/1991 European Pat. Off. .
0418634 3/1991 European Pat. Off. .
52-132086 5/1977 Japan .

*Primary Examiner*—Sam Silverberg
*Attorney, Agent, or Firm*—Ernest G. Szoke; Wayne C. Jaeschke; Norvell E. Wisdom, Jr.

[57] ABSTRACT

To form a darkening-resistant chromate ram on the surface of a galvanized steel sheet, the surface of the galvanized steel shut is treated with a phosphate treatment solution before it is chromate-treated in such a way that zinc phosphate crystals will cover from 10–60% of the substrate surface.

20 Claims, No Drawings

MAKING GALVANIZED STEEL WITH EXCELLENT DARKENING RESISTANCE

TECHNICAL FIELD

The present invention concerns a method for surface-treating galvanized steel, especially in sheet form. More specifically, the present invention concerns a method for forming a chromate film which is resistant to darkening (i.e., resistant to the production of black rust) on the surface of galvanized steel. As far as the present specification is concerned, the expression "galvanized steel" signifies steel coated with zinc or a zinc alloy by electroplating or melt-coating.

BACKGROUND ART

As far as methods for preventing the corrosion of iron steels are concerned, galvanizing, which is based on the principle of sacrificial corrosion, is the most effective and economical method. In response to the demand to increase the added values of steel sheets, nearly 90% of thin steel sheets (especially surface-treated steel sheets, with a production of 15 million tons) are accounted for by galvanized steel sheets, and they are used in diverse fields (e.g., building materials, automobiles, household electrical appliances, etc.).

The sacrificial corrosion mechanism of zinc can be expressed as follows: a galvanic cell is formed in a state where two metals (i.e., zinc and iron) are contacted; zinc, which is the baser of the two metals, serves as an anode, whereas iron serves as a cathode; as a result, anodic dissolution of the iron due to the formation of a local cell, which is observed in a case where iron is used alone, is inhibited, and accordingly, the corrosion of the iron or steel is prevented. The corrosion-preventive function is exhausted upon the disappearance of the zinc contacted with the iron, and therefore, it is necessary to inhibit the corrosion of the zinc layer in order to sustain the protective function and effects over an extended period of time. Galvanized sheets are chromate-treated as a mechanism for serving this function.

This chromate treatment corrosion-preventive method, however, has the following problem. When a galvanized steel sheet is chromate-treated, the formation of white rust on the zinc is significantly inhibited, but when the sheet is stored or transported, black rust (also referred to as "darkening") is observed, and the physical appearance of the steel sheet is inferior when it is actually used. This phenomenon also depends on the surface state of the galvanized steel sheet. It has been determined that this tendency is especially noticeable in a case where a skin pass treatment is performed after treating or in the case of a steel sheet plated with a zinc/aluminum alloy containing several percent of aluminum.

As is noted in Japanese Patent Disclosure number Tokkai Sho 59[1984]–177381 (Kokai Hei 3[1991]–49982), a method wherein extremely small quantities of metals are chemically deposited by means of a preliminary treatment in the presence of an aqueous solution containing nickel or cobalt ions prior to a chromate treatment (referred to as the nickel or cobalt "flash treatment") seems promising for preventing the darkening after the chromate treatment.

As a similar technique, a method wherein a galvanized steel sheet is preliminarily treated with an iron ion-containing aqueous solution prior to a chromate treatment has been proposed in Japanese Patent Disclosures Tokkai Sho 62[1987]–20881 and Sho 62[1987]–17183.

The form of the metal thereby deposited may be an elemental metal or its oxide. There are no established theories, however, regarding the mechanism by which this flash treatment prevents the darkening of the galvanized steel sheet as a result of the chromate treatment.

It is mentioned in *Proceedings from the 60th Metal Surface Technology Society Lecture Convention,* pp. 150–151 that flashed metals are preferentially deposited in zinc crystal grain boundaries, and a chromium-containing compound which has been adhered as a result of a subsequent coat-type chromate treatment is extensively distributed in the grain boundaries, as in the case of the flashed meals. Thus, it may be assumed that the chromium-containing compound is adsorbed on and fixed to the flashed metals due to some interactions between the flashed meals and chromium-containing compound.

It is believed that black zinc rust, which causes darkening, is a basic zinc carbonate represented by $(ZnCO_3)_x \cdot (Zn(OH_2)_y$, as in the case of white rust. The difference is thought to be the depletion of oxygen from a stoichiometric point of view. Black rust is a corrosion product obtained in an oxygen-depleted state, and it is presumably formed as the corrosion progresses from the grain boundaries. Thus, it may be expected that the chromium compound which has been concentrated in the grain boundaries by the flashed metals inhibits corrosion from the grain boundaries, thus contributing to the prevention of the production of black rust.

DISCLOSURE OF THE INVENTION

Problems to Be Solved by the Invention

The black rust problem of the galvanized steel sheet can be thus alleviated if nickel, cobalt, iron, etc. are flash coated prior to a chromate treatment. However, if this flash treatment is performed, as the quantity of the flash coated metal increases, the production of black rust is inhibited, but the production of white rust is increased. Therefore, a method of adequately and economically preventing both black rust or darkening and white rust on galvanized steel is still needed.

SUMMARY AND DETAILED DESCRIPTION OF THE INVENTION

It has been discovered that it is most effective to deposit and form patchy zinc phosphate crystals by means of a brief phosphate treatment solution before the surface of the galvanized steel sheet is chromate-treated. In such a case, it is impossible to use a complete film (i.e., a film which covers the entire material surface) for the phosphate treatment, contrary to the situation where phosphate films are used as primer-coating agents or plasticizing auxiliary lubricants. It is absolutely necessary that the zinc phosphate crystals be formed in patches covering only part of the surface in such a way that the area ratio of the zinc phosphate film crystals with respect to the entire surface of the galvanized steel sheet (hereafter referred to simply as the "coverage"; see application examples for measurement procedures) will be 10–60%. If a chromate treatment is subsequently performed, the black rust production of a galvanized steel sheet which is being manufactured can be inhibited without adversely affecting the white rust resistance.

If only white rust resistance were important, the maximum extent of coverage by the zinc phosphate crystals would not need to be restricted. However, a zinc phosphate film consists of crystalline grains with sizes of several μm to several dozen μm. In the case of a complete film, a dark-gray delustered appearance is observed. If the coverage is excessively high, therefore, a dark-gray appearance is observed from the beginning, which is different from the white and lustrous appearance of the galvanized steel sheet surface. If the intrinsic physical appearance of the galvanized steel sheet is altered by the large quantity of the zinc phosphate film, the commercial value of the sheet decreases. In order to avoid this problem, therefore, it is necessary that the maximal coverage of the galvanized surface by the zinc phosphate crystals should be limited to 60%.

Next, a phosphate treatment solution which is used for depositing and forming zinc phosphate crystals in a patchwise manner on the surface of a galvanized steel sheet at a coverage of 10–60% in the present invention at a high practical operative efficiency will be explained. As a basic rule, a phosphate solution which has been moderately neutralized by caustic soda, etc. can be employed. In actuality, however, it is desirable to add various metal ions and anions in order to induce more effective chemical reactions.

In other words, it is desirable to add zinc, metal ions other than zinc (e.g., nickel, cobalt, manganese, iron, etc.), nitrates, anions other than nitrates (e.g., fluorine ions, fluorides such as duosilicate ions, duoborate ions, and the like), or acid fluorides. Of the aforementioned metal ions, the zinc is solubilized and dissolved from the base material as the treatment continues. Under normal circumstances, however, said metal ion is present from the beginning in such a way that a stable film will be formed in the initial phase of the treatment solution bath treatment.

The metal ion selected from among nickel, cobalt, manganese, and iron accelerates the chemical reaction in an auxiliary fashion. It is believed that small quantities of these metal ions are deposited after they have received some of the electrons which have been produced as a result of an etching reaction. Since the metal deposition occurs in the initial phase of the zinc phosphate-forming reaction, it occurs in lower film segments, and as far as the darkening resistance of the galvanized steel sheet is concerned, it is assumed that the effects are similar to those of the conventional flash treatment.

The upper deposited metal layer, on the other hand, is covered with electrochemically inert zinc phosphate crystals, and accordingly, there are no problems regarding the white rust resistance, which is problematic in conventional methods. The zinc phosphate crystals claimed in the present invention may contain small quantities of metal ions such as nickel, cobalt, manganese, and/or iron, and there are no special restrictions on the types and concentrations of these metals.

As far as anions are concerned, anions of nitric acid, which is an oxidalive acid. accelerate the etching reaction of zinc by maintaining the oxidation/reduction potential in the treatment solution at a high level, and as a result, the overall chemical reaction is accelerated. Anions from hydrofluoric acid, fluosilicic acid, fluoboric acid, and the like remove oxides and the like from the galvanized surface, based on the high electrical negativity of fluorine, and the zinc-etching reaction is likewise accelerated.

In the case of a zinc-aluminum alloy with an aluminum content (in the zinc plate) of 5% or 55%, which is a type of galvanized steel sheet, aluminum is simultaneously solubilized into the chemical solution, and as a result, the film-forming reaction may be hindered. It is extremely effective to add a small quantity of a fluorine-containing compound in order to prevent this problem. In an actual operation, the surface treatment process may be allowed only a short period of several seconds (hereinafter often abbreviated "sec") in consideration of the operative efficiency and facility limitations during a complete process for manufacturing a galvanized steel sheet. For this reason, it is wise to improve the film formation efficiency by adding reasonable quantities of the aforementioned auxiliary reaction agents.

The following is a treatment solution composition appropriate for efficiently forming zinc phosphate crystals on a galvanized steel sheet in consideration of the aforementioned factors: phosphate ions: 5–20, preferably 6–15, grams per liter (hereinafter usually abbreviated as "g/L"); zinc ions: 0.5–2, preferably 1.5–2.0, g/L; total of other non-alkali metal ions (e.g., nickel, cobalt, manganese, iron, etc.): 0.5 3, preferably 0.5–1.0, g/L; nitrate ions: 1–10, preferably 2.0–7.0, g/L; total fluorine in ions containing fluorine: 0.5–3, preferably 1.0–1.5 g/L. Independently, it is preferred that the treatment solution have from 0.5 to 2.0, preferably from 0.9 to 1.1, points of Free Acid and from 12 to 25, preferably from 17.5 to 22, points of total acid. (The definition of the "points" is given in the notes to Table 1 below.)

Nitrite ions may be used as co-oxidizing agents for zinc phosphate treatments of iron materials. In the case of a zinc base, as in the present invention, the presence of nitrite ions does not exert adverse effects, but it is usually unnecessary. Chlorate ions are also conceivable as oxidizing agents for phosphate treatments. Said ions, however, are decomposed and then accumulated as chlorine ions. If said ions are adhered to the chemical film as pollutants, the white rust resistance deteriorates, and therefore, they are not desirable additives.

There are no special restrictions on the zinc phosphate treatment procedures of the present invention, and accordingly, conventionally-known methods can be employed. In other words, a treatment solution may be sprayed or coated on a substrate to be treated in accordance with the invention, or the substrate may be immersed in the treatment solution, and crystals are deposited as a result of a chemical or electrochemical treatment. Subsequently, the resulting crystals are washed with water. There are no special restrictions on the drying procedures. If the migration of washing water into the chromate treatment solution in the subsequent process is a problem, it is desirable that the zinc phosphate crystals present in the coating be dried. In such a case, the evaporation of water from the surface of the galvanized steel sheet suffices. Generally speaking, the crystals may be dried by elevating the temperature of the rinse water or by using a separate drying oven, so as to reach a panel temperature of 40°–100° C.).

As far as ordinary zinc phosphate treatments are concerned, a low-alkalinity aqueous solution containing colloidal titanium is usually spray-coated or dip-coated on the substrate to improve the adhesion of the subsequently applied phosphate coating. This treatment could be used as pan of the present invention. As far as ordinary galvanized steel sheets are concerned, however, a zinc phosphate crystal coverage of 10–60%, which is the target range, can be achieved as a result of the zinc phosphate treatment alone, and therefore, conventional pretreatment with colloidal titanium is not mandatory.

In addition to the aforementioned treatment solution composition, the temperature and time are relevant zinc phosphate treatment conditions. The crystal deposition state during a zinc phosphate treatment cannot be uniformly defined since it depends on the surface state of the galvanized steel sheet to be treated, and therefore, these conditions should be controlled in such a way that the zinc phosphate crystal coverage will fall into the target range of 10–60%.

During the zinc phosphate treatment, there is a positive correlation between the treatment time and the quantity of the adhered film, but as the treatment time exceeds a certain level and as the zinc phosphate crystal coverage approaches 100%, the exposed zinc base segment is eliminated. As a result, the etching reaction is terminated, and the quantity of the adhered film is gradually saturated. The treatment procedures must be controlled in order to control the coverage within the range of 10–60% in the present invention, and the procedures can be easily controlled empirically. In other words, as far as the aforementioned optimal treatment solution composition of the present invention is concerned, the target coverage can be virtually achieved at a temperature of 40°–70 ° C. over a period of 2–20 sec.

In the paragraphs to follow, the present invention will be illustrated in further detail with reference to application examples and comparative examples. It should be noted, however, that these application examples simply illustrate the present invention, and the scope of the present invention is in no way restricted to them.

EXAMPLES

General Procedures

Each of the sample test sheets shown in (1) below, for both examples according to the invention and comparative examples (with some exceptions as explicitly noted below for the latter), underwent the process steps (2) and (3) shown below (i.e., alkaline degreasing and water-rinsing), and subsequently, it was treated with zinc phosphate by using the zinc phosphate treatment solution shown in Table I under the conditions shown in Tables II through V in the process steps (4) through (6) shown below. Subsequently, a chromate treatment was performed in the process steps (7) and (8) shown below, and as a result, a test sheet was obtained. Standard test sheets which had not been treated with zinc phosphate (Comparative Examples 5, 11, 17, and 23) were directly chromate-treated without recourse to the process steps (4) through (6). In the cases of standard test sheets which were flashed with Co as a preliminary treatment for the chromate treatment in place of the zinc phosphate treatment (Comparative Examples 6, 12, 18, and 24), the process step (4') was substituted for process step (4). After each sample test sheet had undergone the foregoing treatment procedures, the resulting film was analyzed according to procedures of step (9) shown below, and a black rust acceleration test and a white rust acceleration test were conducted according to the procedures shown in steps (10) and (11) below.

Table 1 shows the compositions of zinc phosphate treatment solutions employed in the application examples and comparative examples. Tables 2, 3, 4, and 5 show the zinc phosphate treatment conditions for different sample galvanized steel sheets, film analytical data, and the results of the black rust acceleration test and a white rust acceleration test.

TABLE 1

ZINC PHOSPHATE TREATMENT SOLUTION COMPOSITIONS

| Components: | $Zn^{+2}$ | $Ni^{+2}$ | $Mn^{+2}$ | $Co^{+2}$ | $PO_4^{+3}$ | $NO_3^-$ | F | FA | TA |
|---|---|---|---|---|---|---|---|---|---|
| Treatment Solution 1 | 2.0 | 1.5 | — | — | 6.0 | 2.0 | 1.5 | 1.1 | 18.0 |
| Treatment Solution 2 | 2.0 | — | — | 1.0 | 6.0 | 2.0 | 1.5 | 1.0 | 17.5 |
| Treatment Solution 3 | 1.5 | 1.0 | 0.5 | — | 15.0 | 7.0 | 1.0 | 0.9 | 22.0 |

Notes for Table 1

The numbers listed under the individual components are g/L, except for free acid ("FA") and total acid ("TA") respectively, which are expressed as conventional "points", i.e., milliliters of 0.1 N NaOH solution required to titrate a 10 milliliter sample of the solution to a pH value of 3.8 or 8.2 respectively. The fluorine ("F") content is added as a mixture of hydrofluoric and fluosilicic acids. After all other constituents had been added to the treatment solution, the FA and TA values were adjusted to the levels shown by additions of sodium carbonate.

(1) Sample test sheet: Molten Zn-coated, molten Zn+5% Al alloy-coated, molten Zn+55% Al alloy-coated, and zinc-electrogalvanized.

(2) Alkaline degreasing: Spray degreasing was performed over a 30 sec period at a temperature of 60° C. by using a low-alkalinity degreasing agent (PALKLIN™ 342, manufactured by Nihon Parkerizing, 2% aqueous solution).

(3) Rinsing: Spray rinsing with tap water for 10 sec.

(4) Zinc phosphate chemical treatment: Zinc phosphate crystals were deposited at a certain coverage by using the chemical treatment solutions shown in Tables 1 through 4 under the treatment conditions shown in the same tables.

(4') A cobalt flash treatment was performed according to the procedures of Application Example 1-d in Japanese Patent Disclosure number Tokkai Sho 59[1984]7381.

(5) Rinsing: spray rinsing with tap water for 10 sec.

(6) Drying: ultimate/maximal sheet temperature: 50° C.; drying time: 2 sec.

TABLE 2

RESULTS FOR SHEETS MELT-COATED WITH ZINC

| | Number | Type of Preliminary Treatment | Treatment Temperature/ Time | Amount of Phosphate Coverage in mg/m² Total Zinc Phosphate | Amount of Phosphate Coverage in mg/m² Other Metal Amount and Type | Percent Coverage of the Surface by Zinc Phosphate | Rating in Black Rust Accelera-tion Test | Rating in White Rust Accelera-tion Test |
|---|---|---|---|---|---|---|---|---|
| Examples According to the Invention | 1 | Treatment Solution 1 | 65° C./2 sec | 290 | 2.5 Ni | 21 | 5 | 5 |
| | 2 | Treatment Solution 1 | 65° C./4 sec | 570 | 12.1 Ni | 48 | 5 | 5 |
| | 3 | Treatment Solution 1 | 65° C./5 sec | 880 | 17.6 Ni | 55 | 5 | 5 |
| | 4 | Treatment Solution 2 | 65° C./4 sec | 550 | 9.2 Co | 41 | 5 | 5 |
| | 5 | Treatment Solution 3 | 43° C./5 sec | 310 | 8.3 Ni + Mn | 14 | 5 | 5 |
| | 6 | Treatment Solution 3 | 43° C./10 sec | 870 | 29.3 Ni + Mn | 49 | 5 | 5 |
| Comparative Examples | 1 | Treatment Solution 1 | 65° C./1 sec | 140 | 0.2 Ni | 5 | 2 | 5 |
| | 2 | Treatment Solution 3 | 43° C./2 sec | 200 | 2.3 Ni + Mn | 6 | 2 | 5 |
| | 3 | Treatment Solution 3 | 43° C./40 sec | 1420 | 75.3 Ni + Mn | 82 | Note[1] | 5 |
| | 4 | Treatment Solution 3 | 43° C./2 min | 1760 | 87.7 Ni + Mn | 100 | Note[1] | 5 |
| | 5 | No treatment | — | — | — | — | 1 | 5 |
| | 6 | Cobalt flash treatment[2] | 60° C./2 sec | — | 2.2 Co | — | 5 | 2 |

Notes for Table 2
[1]The physical appearance was an unsatisfactory dark grey, with luster lost, before the test and did not change.
[2]Method as specified in Example 1-d in Japanese Patent Disclosure No. Tokai Sho 59[1984]-177381.

TABLE 3

RESULTS FOR SHEETS MELT-COATED WITH 95% ZINC/5% ALUMINUM ALLOY

| | Number | Type of Preliminary Treatment | Treatment Temperature/ Time | Amount of Phosphate Coverage in mg/m² Total Zinc Phosphate | Amount of Phosphate Coverage in mg/m² Other Metal Amount and Type | Percent Coverage of the Surface by Zinc Phosphate | Rating in Black Rust Accelera-tion Test | Rating in White Rust Accelera-tion Test |
|---|---|---|---|---|---|---|---|---|
| Examples According to the Invention | 7 | Treatment Solution 1 | 65° C./2 sec | 240 | 2.5 Ni | 18 | 5 | 5 |
| | 8 | Treatment Solution 1 | 65° C./4 sec | 590 | 13.5 Ni | 44 | 5 | 5 |
| | 9 | Treatment Solution 1 | 65° C./5 sec | 840 | 16.9 Ni | 54 | 5 | 5 |
| | 10 | Treatment Solution 2 | 65° C./4 sec | 560 | 10.6 Co | 47 | 5 | 5 |
| | 11 | Treatment Solution 3 | 43° C./5 sec | 300 | 8.9 Ni + Mn | 18 | 5 | 5 |
| | 12 | Treatment Solution 3 | 43° C./10 sec | 840 | 28.1 Ni + Mn | 54 | 5 | 5 |
| Comparative Examples | 7 | Treatment Solution 1 | 65° C./1 sec | 130 | 0.2 Ni | 6 | 2 | 4 |
| | 8 | Treatment Solution 3 | 43° C./2 sec | 100 | 1.8 Ni + Mn | 6 | 1 | 4 |
| | 9 | Treatment Solution 3 | 43° C./40 sec | 1350 | 89.8 Ni + Mn | 79 | Note[1] | 5 |
| | 10 | Treatment Solution 3 | 43° C./2 min | 1890 | 105.7 Ni + Mn | 100 | Note[1] | 5 |
| | 11 | No treatment | — | — | — | — | 1 | 4 |
| | 12 | Cobalt flash treatment[2] | 60° C./2 sec | — | 2.1 Co | — | 5 | 1 |

Notes for Table 3
[1]The physical appearance was an unsatisfactory dark grey, with luster lost, before the test and did not change.
[2]Method as specified in Example 1-d in Japanese Patent Disclosure No. Tokai Sho 59[1984]-177381.

TABLE 4

RESULTS FOR SHEETS MELT-COATED WITH 45% ZINC/55% ALUMINUM ALLOY

| | Number | Type of Preliminary Treatment | Treatment Temperature/ Time | Amount of Phosphate Coverage in mg/m² Total Zinc Phosphate | Amount of Phosphate Coverage in mg/m² Other Metal Amount and Type | Percent Coverage of the Surface by Zinc Phosphate | Rating in Black Rust Accelera-tion Test | Rating in White Rust Accelera-tion Test |
|---|---|---|---|---|---|---|---|---|
| Examples According to the Invention | 13 | Treatment Solution 1 | 65° C./2 sec | 230 | 3.0 Ni | 21 | 5 | 5 |
| | 14 | Treatment Solution 1 | 65° C./4 sec | 510 | 13.1 Ni | 50 | 5 | 5 |
| | 15 | Treatment Solution 1 | 65° C./5 sec | 790 | 15.9 Ni | 55 | 5 | 5 |
| | 16 | Treatment Solution 2 | 65° C./4 sec | 500 | 12.9 Co | 48 | 5 | 5 |
| | 17 | Treatment Solution 3 | 43° C./5 sec | 280 | 10.3 Ni + Mn | 15 | 5 | 5 |
| | 18 | Treatment Solution 3 | 43° C./10 sec | 710 | 30.4 Ni + Mn | 58 | 5 | 5 |
| Comparative Examples | 13 | Treatment Solution 1 | 65° C./1 sec | 100 | 0.4 Ni | 4 | 2 | 5 |
| | 14 | Treatment Solution 3 | 43° C./2 sec | 100 | 1.9 Ni + Mn | 6 | 2 | 4 |
| | 15 | Treatment Solution 3 | 43° C./40 sec | 1310 | 69.5 Ni + Mn | 67 | Note[1] | 5 |
| | 16 | Treatment Solution 3 | 43° C./2 min | 1610 | 93.6 Ni + Mn | 100 | Note[1] | 5 |
| | 17 | No treatment | — | — | — | — | 1 | 4 |
| | 18 | Cobalt flash treatment[2] | 60° C./2 sec | — | 2.1 Co | — | 5 | 2 |

Notes for Table 4
[1]The physical appearance was an unsatisfactory dark grey, with luster lost, before the test and did not change.
[2]Method as specified in Example 1-d in Japanese Patent Disclosure No. Tokai Sho 59[1984]-177381.

TABLE 5

RESULTS FOR SHEETS ELECTROPLATED WITH ZINC

| | Number | Type of Preliminary Treatment | Treatment Temperature/ Time | Amount of Phosphate Coverage in mg/m² Total Zinc Phosphate | Amount of Phosphate Coverage in mg/m² Other Metal Amount and Type | Percent Coverage of the Surface by Zinc Phosphate | Rating in Black Rust Accelera-tion Test | Rating in White Rust Accelera-tion Test |
|---|---|---|---|---|---|---|---|---|
| Examples According to the Invention | 19 | Treatment Solution 1 | 65° C./2 sec | 310 | 4.2 Ni | 25 | 5 | 5 |
| | 20 | Treatment Solution 1 | 65° C./4 sec | 590 | 14.0 Ni | 51 | 5 | 5 |
| | 21 | Treatment Solution 1 | 65° C./5 sec | 900 | 17.3 Ni | 60 | 5 | 5 |
| | 22 | Treatment Solution 2 | 65° C./4 sec | 590 | 13.5 Co | 47 | 5 | 5 |
| | 23 | Treatment Solution 3 | 43° C./5 sec | 340 | 12.9 Ni + Mn | 20 | 5 | 5 |
| | 24 | Treatment Solution 3 | 43° C./10 sec | 890 | 34.2 Ni + Mn | 55 | 5 | 5 |
| Comparative Examples | 19 | Treatment Solution 1 | 65° C./1 sec | 150 | 0.5 Ni | 10 | 3 | 5 |
| | 20 | Treatment Solution 3 | 43° C./2 sec | 100 | 2.7 Ni + Mn | 11 | 2 | 5 |
| | 21 | Treatment Solution 3 | 43° C./40 sec | 1540 | 98.1 Ni + Mn | 92 | Note[1] | 5 |
| | 22 | Treatment Solution 3 | 43° C./2 min | 2040 | 102.0 Ni + Mn | 100 | Note[1] | 5 |
| | 23 | No treatment | — | — | — | — | 1 | 5 |
| | 24 | Cobalt flash treatment[2] | 60° C./2 sec | — | 2.4 Co | — | 5 | 1 |

Notes for Table 5
[1]The physical appearance was an unsatisfactory dark grey, with luster lost, before the test and did not change.
[2]Method as specified in Example 1-d in Japanese Patent Disclosure No. Tokai Sho 59[1984]-177381.

(7) Chromate treatment: a dispersion obtained by adding colloidal silica to an aqueous chromic acid solution with a trivalent/hexavalent chromium ($Cr^{3+}/Cr^{6+}$) weight ratio of 0.5 in such a way that the weight ratio with respect to the total chromic acid content (as $CrO_3$) would be $CrO_3:SiO_2$= 1:2 was employed. The resulting dispersion was roll-coated at a chromium add-on rate (as metallic chromium) of 45–50 milligrams per square meter (hereinafter often abbreviated as "mg/m²") at a total chromium ($Cr^3+Cr^{6+}$) concentration of 1%.

(8) Drying: ultimate/maximal sheet temperature: 100° C.; drying time: 5 sec.

(9) Film analysis: the quantity of adhered zinc phosphate and the quantity of the adhered and substitution-deposited metal were measured by using a fluorescent X-ray analyzer. The zinc phosphate coverage was calculated in terms of the area ratio of zinc phosphate crystals with respect to the entire visual field of a crystal microgram obtained as a result of a scanning electron microscope observation with a magnifying power of 2,000.

(10) Black rust acceleration test: after multiple 70×150 mm test pieces had been cut and removed from each sample test sheet, a pair was prepared by matching the opposing test surfaces of the test sheets. After 5–10 pairs had been laminated, the resulting structure was wrapped with a vinyl-coated paper, and after four comers had been bolted, a load of 0.67 kg.f.cm was impressed by using a torque wrench, and after the sample had been maintained in a humidity cabinet at 70° C. and 80% relative humidity over a 240 hour period, the darkening state of the laminating interface was evaluated by the naked eye.

Evaluations were reported according to the following numerical scale: 5=no darkening; 4=extremely slight grayish color change; 3=darkening area of less than 25%; 2 = darkening area of 25 % or higher but less than 50 %; 1= darkening area of 50% or higher.

(11) White rust acceleration test: after a 70×150 mm test sheet had been removed from each sample test sheet, the test sheet was sprayed with salt water according to the procedures specified in JIS-Z2371. The white rust production area was evaluated by the naked eye 200 hours later for molten galvanized steel sheets or 500 hours later for 5% or 55% Al-containing galvanized steel sheets.

Evaluations were reported according to the following numerical scale: 5=no white rust: 4=white rust production area of less than 5%; 3=white rust production area of 5% or higher but less than 25%; 2=white rust production area of 25% or higher but less than 50%: 1: white rust production area of at least 50%.

Benefits of the Invention

As the foregoing explanations clearly demonstrate, if the surfaces of various galvanized steel sheets are chromate-treated after they have been preliminarily treated with zinc phosphate by the method of the present invention, the darkening resistance and white rust resistance of each plated steel sheet can be improved in a well-balanced fashion, as Application Examples 1 through 24 indicate. In Comparative Examples 1 and 2, 5, 7 and 8, 11, 13 and 14, 17, 19 and 20, and 23, the quantity of the adhered zinc phosphate is insufficient. Although the white rust resistance is acceptable, the darkening resistance is inadequate. In Comparative Examples 3 and 4, 9 and 10, 15 and 16, and 21 and 22, in which an excess of a zinc phosphate film has been adhered. the physical appearance of the film is dark gray after the chromate treatment, and thus, it is impossible to maintain the lustrous appearance characteristic of the galvanized steel sheet. In Comparative Examples 6, 12, 18, and 24, the darkening resistance is improved by the flashed metal, but white rust is readily produced.

The invention claimed is:

1. A method for imparting an excellent darkening resistance to a conventionally light colored and lustrous galvanized steel surface said method comprising:

(1) treating a galvanized steel surface with a phosphate treatment solution so that zinc phosphate crystals are formed and deposited on only a fraction that is from 10 to 60% of the total area of said surface, and then (2) conventionally treating said surface with a chromating solution.

2. A method according to claim 1, wherein the phosphate treatment solution consists essentially of water and:

(A) from 5 to 20 g/L of phosphate ions;

(B) from 0.5 to 2 g/L of zinc ions:

(C) from 1 to 10 g/L of nitrate ions; and, optionally but preferably, (D) from 0.5 to 3 g/L of cations with a valence of 2 or higher of metals other than zinc; and, optionally but preferably, (E) from 0.5 to 3.0 g/L, measured as the stoichiometric equivalent as elemental fluorine, of anions containing fluorine.

3. A method according to claim 2, wherein the phosphate treatment solution has from 0.5 to 2.0 points of Free Acid and from 12 to 25 points of Total Acid.

4. A method according to claim 1, wherein the phosphate treatment solution has from 0.5 to 2.0 points of Free Acid and from 12 to 25 points of Total Acid.

5. A method according to claim 4, wherein the phosphate treatment solution consists essentially of water and:

(A) from 6 to 15 g/L of phosphate ions;

(B) from 1.5 to 2.0 g/L of zinc ions;

(C) from 2.0 to 7.0 g/L of nitrate ions; and, optionally but preferably, (D) from 0.5 to 1.0 g/L of cations with a valence of 2 or higher of metals other than zinc; and, optionally but preferably, (E) from 1.0 to 1.5 g/L, measured as the stoichiometric equivalent as elemental fluorine, of anions containing fluorine.

6. A method according to claim 5, wherein the phosphate treatment solution has from 0.9 to 1.1 points of Free Acid and from 17.5 to 22 points of Total Acid.

7. A method according to claim 3, wherein the phosphate treatment solution consists essentially of water and:

(A) from 6 to 15 g/L of phosphate ions:

(B) from 1.5 to 2.0 g/L of zinc ions:

(C) from 2.0 to 7.0 g/L of nitrate ions; and, optionally but preferably, (D) from 0.5 to 1.0 g/L of cations with a valence of 2 or higher of metals other than zinc; and, optionally but preferably, (E) from 1.0 to 1.5 g/L, measured as the stoichiometric equivalent as elemental fluorine, of anions containing fluorine.

8. A method according to claim 7, wherein the phosphate treatment solution has from 0.9 to 1.1 points of Free Acid and from 17.5 to 22 points of Total Acid.

9. A method according to claim 2, wherein the phosphate treatment solution consists essentially of water and:

(A) from 6 to 15 g/L of phosphate ions;

(B) from 1.5 to 2.0 g/L of zinc ions;

(C) from 2.0 to 7.0 g/L of nitrate ions; and, optionally but preferably, (D) from 0.5 to 1.0 g/L of cations with a valence of 2 or higher of metals other than zinc; and, optionally but preferably, (E) from 1.0 to 1.5 g/L, measured as the stoichiometric equivalent as elemental fluorine, of anions containing fluorine.

10. A method according to claim 9, wherein the phosphate treatment solution has from 0.9 to 1.1 points of Free Acid and from 17.5 to 22 points of Total Acid.

11. A method according to claim 1, wherein the phosphate treatment solution consists essentially of water and:

(A) from 6 to 15 g/L of phosphate ions;

(B) from 1.5 to 2.0 g/L of zinc ions;

(C) from 2.0 to 7.0 g/L of nitrate ions; and, optionally but preferably, (D) from 0.5 to 1.0 g/L of cations with a valence of 2 or higher of metals other than zinc; and, optionally but preferably, (E) from 1.0 to 1.5 g/L, measured as the stoichiometric equivalent as elemental fluorine, of anions containing fluorine.

12. A method according to claim 11, wherein the phosphate treatment solution has from 0.9 to 1.1 points of Free Acid and from 17.5 to 22 points of Total Acid.

13. A method according to claim 12, wherein the temperature of the phosphate treatment solution during its contact with the galvanized steel surface is within the range from 40° to 70° C. and the time of contact is in the range from 2 to 20 seconds.

14. A method according to claim 11, wherein the temperature of the phosphate treatment solution during its contact with the galvanized steel surface is within the range from 40° to 70 ° C. and the time of contact is in the range from 2 to 20 seconds.

15. A method according to claim 9, wherein the temperature of the phosphate treatment 0393 solution during its contact with the galvanized steel surface is within the range from 40° to 70 ° C. and the time of contact is in the range from 2 to 20 seconds.

16. A method according to claim 7, wherein the temperature of the phosphate treatment solution during its contact with the galvanized steel surface is within the range from 40° to 70 ° C. and the time of contact is in the range from 2 to 20 seconds.

17. A method according to claim 6, wherein the temperature of the phosphate treatment solution during its contact with the galvanized steel surface is within the range from 40° to 70 ° C. and the time of contact is in the range from 2 to 20 seconds.

18. A method according to claim 5, wherein the temperature of the phosphate treatment solution during its contact with the galvanized steel surface is within the range from 40° to 70 ° C. and the time of contact is in the range from 2 to 20 seconds.

19. A method according to claim 3, wherein the temperature of the phosphate treatment solution during its contact with the galvanized steel surface is within the range from 40° to 70 ° C. and the time of contact is in the range from 2 to 20 seconds.

20. A method according to claim 1, wherein the temperature of the phosphate treatment solution during its contact with the galvanized steel surface is within the range from 40° to 70 ° C. and the time of contact is in the range from 2 to 20 seconds.

* * * * *